US006850725B2

(12) United States Patent
Silence et al.

(10) Patent No.: US 6,850,725 B2
(45) **Date of Patent: *Feb. 1, 2005**

(54) TONERS AND DEVELOPERS

(75) Inventors: Scott M. Silence, Fairport, NY (US); William H. Hollenbaugh, Jr., Rochester, NY (US); Thomas R. Pickering, Webster, NY (US); Amy L. Stamp, Rochester, NY (US); Roger N. Ciccarelli, Rochester, NY (US); Denise R. Bayley, Fairport, NY (US); Samuel Kaplan, Walworth, NY (US); Alexander N. Klymachyov, Rochester, NY (US); John S. Walters, Pittsford, NY (US); Padam K. Angra, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/871,299

(22) Filed: Jun. 18, 2004

(65) Prior Publication Data

US 2004/0229144 A1 Nov. 18, 2004

Related U.S. Application Data

(62) Division of application No. 10/261,129, filed on Sep. 27, 2002, now Pat. No. 6,756,176.

(51) Int. Cl.[7] ..... G03G 15/14
(52) U.S. Cl. ..... 399/297; 399/308
(58) Field of Search ..... 399/297, 308, 399/262, 252

(56) References Cited

U.S. PATENT DOCUMENTS

| | | | | |
|---|---|---|---|---|
| 3,590,000 | A | 6/1971 | Palermiti et al. | 252/62.1 |
| 4,298,672 | A | 11/1981 | Lu | 430/108 |
| 4,338,390 | A | 7/1982 | Lu | 430/106 |
| 4,375,673 | A | 3/1983 | Lewis et al. | 364/555 |
| 4,558,108 | A | 12/1985 | Alexandru et al. | 526/340 |
| 4,935,326 | A | 6/1990 | Creatura et al. | 430/108 |
| 4,937,166 | A | 6/1990 | Creatura et al. | 430/106 |
| 5,227,460 | A | 7/1993 | Mahabadi et al. | 528/272 |
| 5,545,501 | A | 8/1996 | Tavernier et al. | 430/106.6 |
| 5,556,727 | A | 9/1996 | Ciccarelli et al. | 430/45 |
| 6,365,316 | B1 | 4/2002 | Stamp et al. | 430/111.41 |
| 6,426,170 | B1 | 7/2002 | Bayley et al. | 430/108.4 |
| 6,451,495 | B1 | 9/2002 | Bayley et al. | 430/108.4 |

OTHER PUBLICATIONS

Schaffert, Electrophography, Wiley & Sons 1975 pp. 603–604.*

* cited by examiner

*Primary Examiner*—John L Goodrow
(74) *Attorney, Agent, or Firm*—E. D. Palazzo

(57) ABSTRACT

An apparatus comprised of a charging component, a development component, a transport component, a photoconductive component, and a fusing component, and wherein the development component contains a toner comprising at least one binder in an optional amount of from about 85 to about 99 percent by weight, at least one colorant in an optional amount of from about 0.5 to about 15 percent by weight, and calcium stearate in an optional amount of from about 0.05 to about 2 percent by weight and wherein following triboelectric contact with carrier particles, the toner has a charge Q measured in femtocoulombs per particle diameter D measured in microns (Q/D) of from about −0.1 to about −1 fC/$\mu$m with a variation during development of from about 0 to about 0.25 fC/$\mu$m and wherein the distribution is substantially unimodal and possesses a peak width of from about 0.1 fC/$\mu$m to about 0.5 fC/$\mu$m and the toner possesses a charge to mass M, as measured in grams, ratio (Q/M) of from about −25 to about −70 $\mu$C/gram with variation of Q/M during development of from about 0 to about 15 $\mu$C/gram.

21 Claims, No Drawings

TONERS AND DEVELOPERS

This is a Divisional of application Ser. No. 10/261,129, filed Sep. 27, 2002.

Illustrated in U.S. Pat. No. 6,756,176, the disclosure of which is totally incorporated herein by reference, is a process comprising heating a sulfonated polyester resin latex and a colorant below about the glass transition temperature (Tg) of the sulfonated polyester resin; adding a metal stearate to the resulting slurry, and isolating the product, and wherein the heating generates an alkyl carboxylate metal salt component ionically attached to the surface of the product.

CROSS-REFERENCE TO RELATED APPLICATIONS

Illustrated in copending application U.S. Serial No. 10,260,377, the disclosure of which is totally incorporated herein by reference, is a process comprising heating a sulfonated polyester resin latex and a colorant below about the glass transition temperature (Tg) of the sulfonated polyester resin; adding a metal stearate to the resulting slurry, and isolating the product, and wherein the heating generates an alkyl carboxylate metal salt component ionically attached to the surface of the product.

Illustrated in U.S. Pat. No. 6,451,495 entitled Toner and Developer Compositions with Charge Enhancing Additives, the disclosure of which is totally incorporated herein by reference, is a toner comprised of resin, colorant, and a potassium sorbate, or a potassium tartrate charge enhancing additive.

Illustrated in U.S. Pat. No. 6,426,170, the disclosure of which is totally incorporated herein by reference, is a toner containing resin, colorant, and a potassium sorbate, or a potassium tartrate charge enhancing additive.

Illustrated in U.S. Pat. No. 6,365,316, the disclosure of which is totally incorporated herein by reference, is a toner comprised of at least one binder, at least one colorant, and optionally one or more additives, and wherein following triboelectric contact with carrier particles, the toner has a charge per particle diameter (Q/D) of from −0.1 to −1.0 fC/$\mu$m with a variation during development of from 0 to 0.25 fC/$\mu$m and the distribution is substantially unimodal and possesses a peak width of less than 0.5 fC/$\mu$m and the toner possesses a charge to mass ratio (Q/M) of from −25 to −70 $\mu$C/g with a variation during development of from 0 to 15 $\mu$C/g. Further, illustrated in the aforementioned copending application is a toner containing as a lubricating agent zinc stearate. Disadvantages associated with the use of zinc stearate relate to its undesirable reactions thereof with fuser rolls, donor rolls, wires and the like, especially in xerographic devices, and which disadvantages are avoided or minimized when there is selected a more suitable stearate, such as calcium stearate.

BACKGROUND

This invention relates to toners, developers containing toners, processes thereof, and methods for generating developed images with, for example, offset-like print quality. More specifically, in embodiments thereof the present invention relates to toners and developers with, for example, controlled properties that provide offset-like print quality when used in developing electrostatic images with, for example, a device containing a hybrid scavengeless development system, and wherein calcium stearate is selected as a toner additive.

The toners and developers of the present invention can be selected for a number of electrophotographic marking processes including color processes. One type of color electrophotographic marking process, referred to as image-on-image (IOI) processing, superimposes toner powder images of different color toners onto the photoreceptor prior to the transfer of the composite toner powder image onto the substrate. While the IOI process provides a number of benefits, such as a compact architecture, there can be several challenges to its successful implementation. For instance, the viability of printing system concepts, such as IOI processing, can require development systems that do not interact substantially with a previously toned image. Since several known development systems, such as conventional magnetic brush development and jumping single-component development, interact with the image on the receiver, a previously toned image will be scavenged by subsequent development if interacting development systems are used. Thus, for the IOI process, there is a need for scavengeless or noninteractive development systems, and which need is achievable with the toners and developers of the present invention.

Hybrid scavengeless development (HSD) technology develops toner via a conventional magnetic brush onto the surface of a donor roll. A plurality of electrode wires is closely spaced from the toned donor roll in the development zone. An AC voltage is applied to the wires to generate a toner cloud in the development zone. This donor roll generally comprises a conductive core covered with a thin, for example about 50 to about 200 $\mu$m, partially conductive layer. The magnetic brush roll is held at an electrical potential difference relative to the donor core to produce the field necessary for toner development. The toner layer on the donor roll is then disturbed by electric fields from a wire or set of wires to produce and sustain an agitated cloud of toner particles. Typical AC voltages of the wires relative to the donor are about 700 to about 900 $V_{pp}$ at frequencies of about 5 to about 15 kHz. These AC signals are often square waves, rather than pure sinusoidal waves. Toner from the cloud is then developed onto the nearby photoreceptor by fields created by a latent image. In the present invention in embodiments, while any suitable electrostatic image development device may be used, it is preferred to use a device employing the hybrid scavengeless development system, such as the system illustrated herein, and, for example, U.S. Pat. No. 5,978,633, the disclosure of which is totally incorporated herein by reference.

The achievement of stringent offset-like print quality requirements in a xerographic engine has been enabled in the present invention by IOI xerography of which hybrid scavengeless development is an excellent subsystem component. Both the image quality and the unique subsystem requirements result in highly constrained toner designs of which the toners of the present invention are useful. In addition to achieving offset-like print quality, a digital imaging processes enables customization of each print (such as an address, or special information for regional distribution), which is not as practical with offset lithography.

REFERENCES

U.S. Pat. No. 5,545,501 describes an electrostatographic developer composition comprising carrier particles and toner particles with a toner particle size distribution having a volume average particle size (T) such that 4 $\mu$m$\leqq$T$\leqq$12 $\mu$m, and an average charge (absolute value) pro diameter in femtocoulomb/10 $\mu$m ($C_T$) after triboelectric contact with the carrier particles such that 1 fC/10 $\mu$m$\leqq C_T \leqq$10 fC/10 $\mu$m, and wherein (i) the carrier particles have a saturation magnetization value, $M_{sat}$, expressed in Tesla (T) such that $M_{sat} \geqq 0.30$ T; (ii) the carrier particles have a volume average particle size ($C_{avg}$) such that 30 $\mu$m $\leqq C_{avg} \leqq 60$ $\mu$m; (iii) the volume based particle size distribution of the carrier particles has at least 90 percent of the particles having a particle diameter C such that $0.5\ C_{avg} \leqq C \leqq 2\ C_{avg}$; (iv) the volume based particles size distribution of the carrier particles comprises less than b percent particles smaller than 25 $\mu$m wherein $b=0.35\times(M_{sat})^2\times P$ with $M_{sat}$: saturation magnetization value, $M_{sat}$, expressed in T and P, the maximal field strength of the magnetic developing pole expressed in kA/m, and (v) the carrier particles comprise a core particle coated with a resin coating in an amount (RC) such that 0.2 percent w/w $\leqq$ RC $\leqq$ 2 percent w/w, see the Abstract. This patent indicates that the developers thereof can achieve images when a latent image is developed with a fine hair magnetic brush, see for example, column 4, lines 7 to 17.

Nevertheless, there continues to be a need for a set of developers comprised of toners and carriers that possess a combination of properties such that when used to develop a latent image on the surface of a photoreceptor, preferably in an image-on-image device, and more specifically, in such a device also utilizing a hybrid scavengeless development system, the color image produced exhibits a quality analogous to that achieved in offset lithography. Further, there is a need for toners and developers wherein a toner additive does not substantially interact with fuser oils, fuser rolls, and the like to thereby, for example, increase the useable life, for example from about 200,000 prints to about 1,000,000 prints, of fuser devices, such as fuser rolls, and wherein the toners and developers thereof possess excellent triboelectrical, conductivity, and developability characteristics.

BACKGROUND AND SUMMARY

It is a feature of the present invention to provide a set of color toners and developers each having a set of properties such that the developers containing such toners can achieve xerographically produced images having offset like print quality.

It is a further feature of the invention to provide a set of color toners and developers capable of producing excellent images when used in a development apparatus utilizing a hybrid scavengeless development system.

It is a still further feature of the invention to provide processes for the preparation of the toners and developers with certain consistent, and predictable properties.

Additionally, it is a still further feature of the invention to provide suitable carriers for use in combination with toners to obtain two component developers possessing excellent properties.

Moreover, in another feature of the present invention there are provided toners and developers wherein the lifetime of certain components, such as fuser rolls, fuser oils, and the like, are extended; for example, the life of a fuser roll can be extended from less than about 350,000 impressions to about 1 million or more impressions with the toners of the present invention in embodiments thereof, and wherein there can be achieved developed images with lithographic image quality.

Furthermore, another feature of the present invention relates to the selection of calcium stearate as a lubricant component for toners and developers thereof to thereby permit the toner to adequately move on the surface of the carrier and to provide high developer conductivity, reduced sensitivity of the developer conductivity to the toner concentration, and decreased toner impactation on the carrier particles.

EMBODIMENTS

Aspects of the present invention include a toner comprising at least one binder in an amount, for example, (all amounts recited herein are examples) of from about 85 to about 99 percent by weight, at least one colorant in an amount of from about 0.5 to about 15 percent by weight, and calcium stearate in an amount of from about 0.05 to about 2 percent by weight and wherein following triboelectric contact with carrier particles, the toner has a charge Q measured in femtocoulombs per particle diameter D measured in microns (Q/D) of from about −0.1 to about −1.0 fC/$\mu$m with a variation (Q/D) during development of from about 0 to about 0.25 fC/$\mu$m and wherein the toner distribution is substantially unimodal and possesses a peak width of from about 0.1 fC/$\mu$m to about 0.5 fC/$\mu$m and the toner possesses a charge to mass M, as measured in grams, ratio (Q/M) of from about −25 to about −70 $\mu$C/gram with variation of Q/M during development of from about 0 to about 15 $\mu$C/gram; a toner wherein the mass ratio of the toner is from about −30 to about −60 $\mu$C/gram; a toner wherein the toner contains low charge, less than, for example, about 10 $\mu$C/gram toner particles of equal to or less than about 15 percent of the total number of toner particles, and wrong sign, such as positively charged, toner particles equal to or less than about 5 percent of the total number of toner particles; a toner wherein the toner contains low charge toner of equal to or less than about 6 percent of the total number of toner particles, and wrong sign toner particles equal to or less than about 3 percent of the total number of toner particles; a toner wherein the toner possesses a volume median diameter of from about 6.9 to about 7.9 microns; a toner wherein the toner possesses a size distribution such that about 30 percent or less of the total number of toner particles have a size less than about 5 microns, and about 0.7 percent or less of a total volume of toner particles with a size greater than about 12.7 microns; a toner wherein the toner possesses a volume median diameter of from about 5 to about 25, and more specifically, from about 7.1 to about 7.7 microns; a toner wherein the toner has a low volume ratio GSD (geometric size distribution) of approximately 1.23, and a volume GSD of about 1.21; a toner with a melt viscosity of from about $3\times10^4$ to about $6.7\times10^4$ poise at a temperature of about 97° C., from about $4\times10^3$ to about $1.6\times10^4$ poise at a temperature of about 116° C., or from about $6.1\times10^2$ to about $5.9\times10^3$ poise at a temperature of about 136° C.; a toner wherein the toner elastic modulus is from about $6.6\times10^5$ to about $2.4\times10^6$ dynes per square centimeter at a temperature of about 97° C., from about $2.6\times10^4$ to about $5.9\times10^5$ dynes per square centimeter at a temperature of about 116° C., and from about $2.7\times10^3$ to about $3\times10^5$ dynes per square centimeter at a temperature of about 136° C.; a toner wherein the toner melt flow index (MFI) is from about 1 to about 25 grams per about 10 minutes at a temperature of about 117° C.; a toner wherein the binder has a glass transition temperature of from about 52° C. to about 64° C.; a toner wherein the binder comprises a propoxylated bisphenol A fumarate resin, and the resin possesses an overall gel content of from about 2 to about 9 percent by weight of the binder; a toner wherein the colorant is carbon black, magnetite, or mixtures thereof, cyan, magenta, yellow, blue, green, red, orange, violet, brown, or mixtures thereof; a toner further including external additives of a silicon dioxide powder, a metal oxide powder, or mixtures thereof; a toner wherein the metal oxide powder is titanium dioxide or aluminum oxide; a toner wherein the external additives are of a SAC×size (theoretical surface area coverage×primary particle size of the external additive in nanometers) of from about 4,000 to about 8,000, and more specifically, from about 4,500 to about 7,200; a toner wherein different colors of the toner develop a latent image upon a photoreceptor surface by image-on-image processing with hybrid scavengeless development, the developed image then being transferred to an image receiving substrate; a method comprising forming different color developers by mixing a carrier with a toner comprising toner particles comprised of at least one binder, at least one colorant, and calcium stearate, wherein following triboelectric contact with carrier particles, the toner has a charge per particle diameter (Q/D) of from about −0.1 to about −1 fC/μm with a variation during development of from about 0 to about 0.25 fC/μm and with a distribution that is substantially unimodal and possesses a peak width of less than about 0.5 fC/μm, more specifically, less than about 0.3 fC/μm and the toner has a triboelectric charge of from about −25 to about −70 μC/gram with a variation during development of from about 0 to about 15, and more specifically, from about 5 to about 12 μC/gram; forming a latent image upon a photoreceptor surface, developing any portion of the latent image requiring magenta color with a developer containing a magenta color toner; developing any portion of the latent image requiring yellow color with a developer containing a yellow color toner; developing any portion of the latent image requiring cyan color with a developer containing a cyan color toner; developing any portion of the latent image requiring black color with a developer containing a black color toner; and transferring the developed latent images from the photoreceptor surface to an image receiving substrate; the method wherein each of the developing is each conducted with a hybrid scavengeless development process; an imaging process wherein there is developed an image with a toner, and wherein the toner containing calcium stearate functions as a lubricating component for a device in a machine containing the image; a process wherein the device is a fuser roll; a process wherein the device is a donor roll; a process wherein the device is a photoreceptor; a process wherein the imaging process is a xerographic process; a process wherein the calcium extends the lifetime of the device; a process wherein the device is a fuser roll, and the lifetime is from about 800,000 to about 2,000,000 developed prints; a process wherein the device is a fuser roll, and the lifetime is from about 500,000 to about 1,000,000 developed prints; a process wherein the device is a donor roll, and the lifetime is from about 800,000 to about 2,000,000 prints; a process wherein the device is a donor roll, and the lifetime is from about 500,000 to about 1,000,000 developed prints; a process wherein the device is a photoreceptor, and the lifetime is from about 800,000 to about 2,000,000 prints; a process wherein the device is a fuser roll, and the lifetime is about 1,000,000 developed prints; a process wherein the calcium stearate is present in an amount of from about 0.5 to about 3 weight percent; a process wherein the calcium stearate is present in an amount of from about 0.5 to about 1 weight percent; a toner with calcium stearate present in an amount of from about 0.5 to about 3 weight percent; a toner wherein the calcium stearate is present in an amount of from about 1 to about 5 weight percent; a toner wherein the calcium stearate is present in an amount of about 1 weight percent; a toner wherein the calcium stearate is comprised of ultra fine particles with a size diameter of from about 0.2 micron to about 5 microns, and which stearate has a purity of from about 98 to about 100 percent; a toner wherein the calcium stearate is comprised of ultra fine particles with a size diameter of from about 0.2 micron to about 5 microns; a toner wherein the calcium stearate has a purity of from about 95 to about 100 percent; a toner wherein the calcium stearate has a purity of about 100 percent; a toner wherein the colorant is carbon black; a toner wherein the colorant is a cyan; a toner wherein the colorant is a magenta; a toner wherein the colorant is a yellow; a toner wherein the colorant is carbon black, cyan, magenta, yellow, or mixtures thereof; a toner wherein the colorant is carbon black, cyan, yellow, red, blue, violet, green, orange, or mixtures thereof; a toner wherein the binder resin is present in an amount of from about 88 to about 93 percent by weight, the colorant is present in an amount of from about 3 to about 8 percent by weight, and the calcium stearate is present in an amount of from about 0.25 to about 0.75 percent by weight; a toner wherein the resin is a styrene acrylate, a styrene methacrylate, or a polyester; a toner wherein the polyester is a poly (propoxylated bisphenol A fumarate); a toner comprised of resin, colorant and calcium stearate; a composition comprised of a polymer, a colorant, and calcium stearate, and wherein following triboelectric contact with carrier particles, the toner has a charge per particle diameter (Q/D) of from about −0.005 to about −2 Fc/μm, and wherein the toner possesses a charge to mass ratio (Q/M) of from about −20 to about −75 μC/gram; a developer comprised of the toner illustrated herein and carrier; a developer wherein the carrier is a ferrite; a developer wherein the carrier is steel; a developer wherein the carrier contains at least one coating; a toner wherein at least one binder is one; a toner wherein at least one is from about 1 to about 10; a toner wherein at least one is from about 1 to about 4; a toner comprising at least one binder, at least one colorant, and calcium stearate, and wherein following triboelectric contact with carrier particles, the toner has a charge Q measured in femtocoulombs per particle diameter D measured in microns (Q/D) of from about −0.1 to about −1 fC/μm with a variation during development of from about 0 to about 0.25 fC/μm, and wherein the distribution is substantially unimodal and possesses a peak width of from about 0.1 fC/μm to about 0.5 fC/μm, and the toner possesses a charge to mass M, as measured in grams, ratio (Q/M) of from about −25 to about −70 μC/gram with variation of Q/M during development of from about 0 to about 15 μC/gram; a developer comprised of the toner and carrier; two-component developers comprised of magnetic carrier granules with toner particles adhering triboelectrically thereto wherein the toner particles are attracted to a latent image, forming a toner powder image on the photoconductive surface; the toner powder image is subsequently transferred to a substrate like paper, and the toner powder image is heated to permanently fuse it to the substrate in image configuration; toners and developers comprised of resins, colorants, internal additives, external additives and calcium strearate as a lubricating component; toners and developers that enable developed prints with vivid, for example, high chroma, reliable color rendition, excellent color gamut, that is for example, the maximum set of colors that can be printed, is benchmark for a four-color xerographic system wherein solid and halftone areas are uniform and stable in density and color of uniform gloss; that contain an accurate, realistic rendition wherein the text is crisp with well-defined edges irrespective of font size or type; substantially no image background deposits; and wherein solids, halftones, gloss, pictorials, text and background are stable for extended time periods, that is exhibit no or minimum perceptible variation in image density, solid or halftone image quality metric such as mottle or graininess, text metric such as line thickness, or overall color quality for periods longer than typical production run, for example 10,000, and wherein the developed prints resulting do not exhibit substantial paper curl, the images are not substantially disturbed by handling or storage, for example when stored in contact with vinyl or other document surfaces, and the like.

Illustrative examples of toner and developer characteristics with respect to a number of the embodiments of the present invention illustrated herein include, for example, A. Toner Particle Size Distribution Small toner size, for example from about 1 to about 25, and more specifically, from about 4 to about 9 microns in volume median diameter, a reduction of TMA (transferred mass per unit area), which is especially of value for Image-On-Image process color systems whereby color toners are layered, that is present as separate layers in contact with each other. High mass of toner on paper permits document "feel" (unlike lithography), stresses fusing latitude, and can increase paper curl. In addition, developability degradation can occur when a second or third toner layer is developed onto the first toner layer, due to development voltage non-uniformity. While small average toner particle size can be useful, there are failure modes identified with extremely small particles such fine toner particles can be a stress to, that is they adversely impact xerographic latitude as they exhibit increased toner adhesion to carrier beads, donor rolls and photoreceptors. Toner fines are also related to development instability due to the lower efficiency of donor roll development of very small particles. Fine toner particles exhibit increased adhesion to the photoreceptor, impairing transfer efficiency and uniformity. The presence of coarse toner particles is related to HSD wire strobing and interactivity, and compromises the rendering of very fine lines and structured images.

Therefore, it is desirable to control the toner particle size and limit the amount of both fine and coarse toner particles. Small toner size is selected and achievable with the present invention to enable high image quality and low paper curl. Narrow toner size distributions are also desired, with relatively few fine and coarse toner particles. In embodiments of the present invention, the finished toner particles possess, for example, an average particle size (volume median diameter) of from about 6.9 to about 7.9 microns, and more specifically, from about 7.1 to about 7.7 microns, as measured by the well known Coulter Counter technique. The fine side of the toner distribution can be controlled with, for example, only about 30 percent (percent by weight throughout) of the number distribution of toner particles (the total number of toner particles) having a size less than about 5 microns, and more specifically, only about 15 percent of the number distribution of toner particles having a size less than about 5 microns. The coarse side of the distribution can also be controlled with only about 0.7 percent of the volume distribution of toner particles having a size greater than about 12.7 microns. This translates into a narrow particle size distribution with a lower volume ratio geometric standard deviation (GSD) of approximately 1.23 and an upper volume GSD of approximately 1.21. Therefore, in embodiments the toners of the present invention possess a small average particle size and a narrow particle size distribution.

B. Toner Melt Rheology

As imaging and printing process speed increases, dwell time through the fuser decreases, resulting in lower toner-paper interface temperatures. During fusing, the toner particles can coalesce, flow and adhere to the substrate (for example, paper, transparency sheets) at temperatures that are consistent with the device process speeds. Toner melt viscosity at the device fusing conditions can be used to provide gloss level, while maintaining a high enough elasticity to prevent fuser roll hot-offset (transfer of toner to the fuser roll). Occurrence of offset results in print defects and a reduction of fuser roll life.

Therefore, it is desirable to select an appropriate toner binder resin and to control its melt rheology to provide a low minimum fuse temperature, broad fusing latitude and desired gloss at the machine operating conditions. It is further desirable to use an appropriate binder resin such that the toner enables long fuser roll life.

The functionality for the toners of the present invention in embodiments thereof is a controlled melt rheology which provides low minimum fuse temperature, broad fusing latitude and desired gloss at machine operating conditions. The minimum fusing temperature is generally characterized by the minimum fix temperature (MFT) of the fusing subsystem (the lowest temperature of fusing that the toner will fix to a substrate like paper, as determined by creasing a section of the paper with a toned image and quantifying the degree to which the toner in the crease separates from the paper). The fusing latitude is generally determined to be the difference between the hot offset temperature (HOT) (i.e., the highest temperature of fusing that can be conducted without causing toner to offset to the fusing roll, as determined by the presence of previous images printed onto current images or the failure of the paper to release from the fuser roll) and the MFT. The gloss level of the fused toner layer (i.e., the shininess of the fused toner layer at a given fusing temperature as determined by industry standard light reflection measurement) is also dependent on the temperature at which the toner is fused, and can further restrict the fusing latitude; that is, if the gloss level of the toner becomes too high at a temperature below the HOT or too low at a temperature above the MFT, this restricted range of temperatures will serve to define the fusing latitude.

The melt rheology profile of the toner can be optimized to provide a low minimum fusing temperature and a broad fusing latitude. The melt rheology profile of the toner of the present invention in embodiments thereof can, for example, possess a viscosity of about $3.9\times10^4$ to about $6.7\times10^4$ poise at a temperature of about 97° C., a viscosity of about $4\times10^3$ to about $1.6\times10^4$ poise at a temperature of about 116° C., and a viscosity of about $6.1\times10^2$ to about $5.9\times10^3$ poise at a temperature of about 136° C. The melt rheology profile of the toner possesses in embodiments an elastic modulus of about $6.6\times10^5$ to about $2.4\times10^6$ dynes per square centimeter at a temperature of about 97° C., an elastic modulus of about $2.6\times10^4$ to about $5.9\times10^5$ dynes per square centimeter at a temperature of about 116° C., and an elastic modulus of between about $2.7\times10^3$ and about $3\times10^5$ dynes per square centimeter at a temperature of about 136° C. Both the viscosity and elastic modulus are determined by measurements using a standard mechanical spectrometer at 40 radians per second. An alternate method of characterizing the toner rheology is by the measurement of the melt flow index (MFI), that is for example, the weight of a toner (in grams) which passes through an orifice of length L and diameter D in a 10 minute period with a specified applied load. The melt rheology profile of the toner of the present invention is, for example, about 1 to about 25 grams per 10 minutes, and preferably about 6 to about 14 grams per 10 minutes at a temperature of about 117° C., under an applied load of about 2.16 kilograms with an L/D die ratio of 3.8. This range of melt rheology profile can in embodiments provide a minimum fix, appropriate gloss and the desired hot offset behavior, thereby for example enabling long fuser roll life.

C. Toner Storage/Vinyl and Document Offset

It is known that toner blocking can be affected by the glass transition temperature (Tg) of the toner binder resin. The resin Tg is directly related, for example, to its chemical composition and molecular weight distribution. A toner resin should be selected such that blocking is not experienced at typical storage temperatures, or a lower value of Tg. The minimum fuse temperature and gloss should also be satisfied, which, to the extent that it affects melt rheology, can illustrate the upper limit on Tg. The application of surface additives further increases the toner blocking temperature over that which is illustrated by the glass transition of the toner binder resin.

After documents are created, they can be stored in contact with vinyl surfaces, such as used in file folders and three ring binders, or in contact with the surface of other documents. Occasionally, finished documents adhere and offset to these surfaces resulting in image degradation; this is known as vinyl offset in the case of offset to vinyl surfaces or document offset in the case of offset to other documents. Some toner binder resins are more susceptible to this phenomenon than others. The chemical composition of the toner binder resin and the addition of certain ingredients can minimize or prevent vinyl and document offset.

Therefore, it is desirable to select a toner binder resin with a chemical composition that prevents or minimizes vinyl and document offset, and possesses an appropriate range of glass transition temperature to prevent toner blocking under storage without negatively affecting fusing properties.

To prevent blocking at typical storage temperatures, but still meet the minimum fuse temperature, a resin should be selected with a Tg (glass transition temperature) in the range of from, for example, about 52° C. to about 64° C.

D. Toner Color

The choice of colorants should enable rendition of a higher percentage of standard PANTONE® colors than is typically available from 4 color xerography. Measurement of the color gamut can, for example, be characterized by CIE (Commission International de I'Éclairage) specifications, commonly referred to as CIELab, where L*, a* and b* are the modified opponent color coordinates, which form a 3 dimensional space, with L* characterizing the lightness of a color, a* approximately characterizing the redness, and b* approximately characterizing the yellowness of a color. The chroma C* is further defined as the color saturation, and is the square root of the sum of squares of a* and b*. For each toner, chroma (C*) should be maximized over the entire range of toner mass on paper. Pigment concentration should be chosen so that maximum lightness (L*) corresponds with the desired toner mass on the substrate. All of these parameters are measured with an industry standard spectrophotometer, obtained, for instance, from X-Rite Corporation.

Therefore, it is desirable to choose toner colorants which, when combined, provide a broad set of colors on the resulting print, that is, cover the broadest possible color space as characterized in the CIELAB coordinate system, with the ability to render accurately desired pictorials, solids, halftones and text E. Toner Flow It is known that toner cohesivity can have detrimental effects on toner handling and dispensing. Toners with excessively high cohesion, for example, from about 70 percent to about 100 percent as measured with, for example, the method illustrated herein, can exhibit "bridging" which prevents fresh toner from being effectively added to the developer mixing system. Conversely, toners with very low cohesion, for example from about 0 percent to about 10 percent, can result in difficulty in controlling toner dispense rates and toner concentration, and can result in excessive dirt in the machine. In addition, in the HSD system, toner particles are first developed from a magnetic brush to two donor rolls. Toner flow should be such that the HSD wires and electric development fields are sufficient to overcome the toner adhesion to the donor roll and enable adequate image development to the photoreceptor. Following development to the photoreceptor, the toner particles should be able to be readily and fully transferred from the photoreceptor to the substrate.

Therefore, it is desirable to tailor toner flow properties to minimize both cohesion of particles to one another, and adhesion of particles to surfaces such as the donor rolls and the photoreceptor. This provides reliable images due to high and stable development and high and uniform transfer.

The toner flow properties thus should minimize both cohesion of particles to one another, and adhesion of particles to surfaces such as the donor rolls and photoreceptor. Toner flow properties can be conveniently quantified by measurement of toner cohesion, for instance by placing a known mass of toner, for example two grams, on top of a set of three screens, for example with screen meshes of about 53 microns, about 45 microns, and about 38 microns in order from top to bottom, and vibrating the screens and toner for a fixed time at a fixed vibration amplitude, for example, for about 90 seconds at a 1 millimeter vibration amplitude. A device to perform this measurement is a Hosokawa Powders Tester, available from Micron Powders Systems. The toner cohesion value is related to the amount of toner remaining on each of the screens at the end of the time. A cohesion value of 100 percent corresponds to all of the toner remaining on the top screen at the end of the vibration and a cohesion value of zero corresponds to all of the toner passing through all three screens, that is, no toner remaining on any of the three screens at the end of the vibration step. The higher the cohesion value, the lesser the flowability of the toner. Minimizing the toner cohesion and adhesion will provide high and stable development and high and uniform transfer. Many additive combinations can provide adequate initial flow enabling development and transfer in HSD systems. Also, high concentrations of relatively large external surface additives enable stable development and transfer over a broad range of area coverage and job run length.

F. Toner Charge

Toner charge distributions are correlated with development and transfer (including transfer efficiency and uniformity) performance. Print quality attributes that are affected by toner charge level include overall text quality (particularly the ability to render fine serifs), line growth/shrinkage, halo (a white region at the interface of two colors, also evident when text is embedded on a solid background), interactivity (toner of one color participating in the development process of another color, for instance by being scavenged from the printed area of a first color and being redeveloped into the printed area of a second color), background and highlight/shadow contrast (TRC). Failure modes identified with low toner charge include positive line shrinkage, negative line growth, halo, interactivity, background, poor text/serif quality, poor highlight contrast and machine dirt. Problems associated with high toner charge include low development, low transfer efficiency (high residual mass per unit area), poor shadow contrast and interactivity.

In addition to tailoring the average toner charge level, the distribution of charge should not contain excessive amounts of high or low (especially opposite polarity) toner charge. HSD can be sensitive to low charge toner since all of the toner that reaches the photoreceptor (both image and background) will be recharged during the process. Low charge toner (and toner of the opposite polarity) will likely develop to the background region, and after recharging can be transferred to the print. Low charge toner also contributes to an accumulation of toner on the surface of the wires that are situated between the donor roll and photoreceptor in an HSD development system, which can cause differential development (spatially and temporally) leading to noticeable image quality defects, a condition called wire history. The distribution should also not contain excessive amounts of high charge toner, as this will reduce developability and transfer.

Additionally, the toner charge level and toner charge distribution should be maintained over a wide range of area coverage (AC) and job run length. Since a device selected for the present invention in embodiments can be a full color machine or an offset apparatus, AC and job run length can vary over a broad range. Print jobs such as annual reports will contain predominantly black text, with cyan, magenta and yellow used only for "spot color" applications such as logos, charts and graphs. For full color pictorials, the job can range from very light pastels, with mostly cyan, magenta and yellow, and very little black, to dark rich colors with high usage of cyan, magenta and yellow. In some scenarios, black will be used as replacement for equal amounts of cyan, magenta and yellow to reduce the overall toner layer thickness. Each has a unique combination of AC for each of the colors cyan, magenta, yellow and black. Toner charge level and distribution cannot vary based on the corresponding average residence time of a toner in the housing (i.e., high AC=low residence time with a lot of turnover of toner in the housing; conversely low AC=high residence time).

It is desired that freshly added toner rapidly gains charge to the same level of the incumbent toner in the developer, or two distinct situations may occur. When freshly added toner fails to rapidly charge to the level of the toner already in the developer, a situation known as "slow admix" occurs. Distributions can be bimodal in nature, meaning that two distinct charge levels exist side-by-side in the development subsystem. In extreme cases, freshly added toner which has no net charge may be available for development onto the photoreceptor. Conversely, when freshly added toner charges to a level higher than that of toner already in the developer, a phenomenon known as "charge-thru" occurs; also characterized by a bimodal distribution, that is the low charge or opposite polarity toner is the incumbent toner (or toner that is present in the developer prior to the addition of fresh toner). The failure modes for both slow admix and charge-thru are the same as those for low charge toner state above, most notably background and dirt in the machine, wire history, interactivity, and poor text quality.

Therefore, it is desirable to design toner and developer materials with an average toner charge level that avoids failure modes of both too high and too low toner charge. This will preserve development of solids, halftones, fine lines and text, as well as prevention of background and image contamination. The distribution of toner charge level should be sufficiently narrow such that the tails of the distribution do not adversely affect image quality (i.e., the low charge population is not of sufficient magnitude so as to degrade the image quality attributes known to be related to low toner charge level). Toner charge level and distribution should be maintained over the full range of customer run modes (job run length and AC).

High average toner charge, and narrow charge distributions are of value under all run conditions (area coverage and job run length) in the present invention. In the invention, appropriate additives as discussed below are chosen to enable high toner charge and charge stability.

The charge of a toner can be illustrated, for example, as either the charge to particle mass, Q/M, in $\mu$C/g, or the charge/particle diameter, Q/D, in fC/$\mu$m following triboelectric contact of the toner with carrier particles. The measurement of Q/M is accomplished by the well-known Faraday Cage technique. The measurement of the average Q/D of the toner particles can be completed by means of a charge spectrograph apparatus as well known in the art. The spectrograph is used to measure the distribution of the toner particle charge (Q in fC) with respect to a measured toner diameter (D in $\mu$m). The measurement result is expressed as percentage particle frequency (in ordinate) of same Q/D ratio on Q/D ratio expressed as fC/10 $\mu$m (in abscissa). The distribution of the frequency over Q/D values often takes the form of a Gaussian or Lorentzian distribution with a peak position (most probably Q/D value) and peak width (characterized, for example, by the width of the peak in fC/$\mu$m at a frequency value of half of the peak value). From this full distribution an average Q/D value can be calculated. In certain circumstances, the frequency distribution will comprise two or more distinct peaks, as in the slow admix and charge-thru behaviors illustrated herein.

To attain the print quality for use in an HSD developer apparatus, the Q/D of the toner particles should in embodiments possess an average value of from, for example, −0.1 to −1 fC/$\mu$m, and preferably from about −0.5 to about −1 fC/$\mu$m. This charge should remain stable throughout the development process to insure consistency in the richness of the images obtained using the toner. Thus, the toner charge should exhibit a change in the average Q/D value of, for example, about 0 to about 0.25 fC/$\mu$m. The charge distribution of the toner, as measured by a charge spectrograph, should be narrow, that is possessing a peak width of less than about 0.5 fC/$\mu$m, and preferably less than about 0.3 fC/$\mu$m, such as about 0.05 to about 2, and unimodal, that is for example, possessing only a single peak in the frequency distribution indicating the presence of no or very little low charge toner (too little charge for a sufficiently strong coulomb attraction) and wrong sign toner. Low charge toner should comprise no more than, for example, about 6 percent of the total toner, more specifically, no more than about 2 percent, while wrong sign toner should comprise no more than, for example, about 3 percent of the total toner, more specifically, no more than about 1 percent.

Using the complementary well known Faraday Cage measurement in order to attain the print quality illustrated herein when used in an HSD developer apparatus with embodiments of the present invention, the toner should also exhibit, for example, a triboelectric value of from, for example, about −25 to about −70 $\mu$C/gram, more specifically, about −30 to about −60 $\mu$C/gram. The tribo should be stable, varying at most from, for example, about 0 to about 15 $\mu$C/gram, and more specifically, from no more than about 0 to about 8 $\mu$C/gram.

The print quality characteristics for HSD product translate into toner functional properties as illustrated herein. In embodiments, functional properties or functionality is designed into the toners with the goal of achieving the many print quality requirements. Four different color toners, cyan (C), magenta (M), yellow (Y) and black (K) are typically used in developing full color images (although other color toners may also be used). Each of these color toners in the present invention are preferably comprised of resin binder, appropriate colorants and an additive package comprised of one or more additives. Suitable and preferred materials for use in preparing toners of the invention that possess the properties illustrated herein will now be discussed. The specific formulations used to achieve the functional properties illustrated herein should not, however, be viewed as restricting the scope of the invention.

G. Developer Charge

The developer charge is correlated with development and transfer (including transfer efficiency and uniformity) performance similar to the toner charge of the toner (Property F) is as illustrated herein.

Therefore, it is desirable to design toner and developer materials to possess an average toner charge level that avoids failure modes of both too high and too low toner charge, for example from about 55 to about 75 $\mu$C/gram for high and from about 10 to about 25 $\mu$C/gram for low. This will preserve development of solids, halftones, fine lines and text, as well as prevention of background and image contamination. The distribution of developer and toner charge level should be sufficiently narrow such that the tails of the distribution do not adversely affect image quality (i.e., the low charge population is not of sufficient magnitude so as to degrade the image quality attributes known to be related to low toner charge level). Developer and toner charge level and distribution should be maintained over the full range of customer run modes (job run length and AC).

As in the situation of toner charge (Section F), the charge of a toner in the developer can be illustrated by either the charge to particle mass, Q/M, in $\mu$C/gram, or the charge/particle diameter, Q/D, in fC/$\mu$m following triboelectric contact of the toner with carrier particles. The measurement of Q/M is accomplished by the known Faraday Cage method. The measurement of the average Q/D of the toner particles, and the full distribution of Q/D values, can be accomplished by means of the known charge spectrograph apparatus. To attain the print quality illustrated herein when used in an HSD developer apparatus of embodiments of the present invention, the Q/D of the toner particles in the developer should possess an average value of from, for example, about −0.1 to about −1 fC/$\mu$m, and more specifically, from about −0.5 to about −1 fC/$\mu$m. This charge should remain stable throughout the development process to insure consistency in the richness of the images obtained using the toner. Thus, the toner charge should exhibit a change in the average Q/D value of, for example, 0 to about 0.25 fC/$\mu$m. The charge distribution of the toner in the developer, as measured by a charge spectrograph, should be narrow, that is possessing a peak width of less than, for example, about 0.5 fC/$\mu$m, and more specifically, less than about 0.3 fC/$\mu$m, such as from about 0.05 to about 0.25, and be unimodal, that is, possessing only a single peak in the frequency distribution indicating the presence of no or very little low charge toner (too little charge for a sufficiently strong coulomb attraction) and wrong sign toner. Low charge toner should comprise, for example, about 15 percent of the total number of toner particles, and more specifically, about 6 percent of the total toner, and further more specifically, no more than about 2 percent, while wrong sign toner should comprise no more than, for example, about 5 percent of the total number of toner particles, more specifically no more than 3 percent of the total toner, and further more specifically no more than 1 percent. Using the known Faraday Cage measurement, the toner in the developer should possess in embodiments a triboelectric value of from, for example, about −25 to about −70 $\mu$C/gram, and more specifically, about −35 to about −60 $\mu$C/gram. The tribo should be stable in embodiments, varying, for example, about 0 to about 15 $\mu$C/gram, more specifically from no more than about 0 to about 8 $\mu$C/gram during development with the toner, for example, during development in an HSD system.

The carrier core and coating, and the toner additives are selected to enable, for example, high developer charge, that is from about 30 to about 50 $\mu$C/gram and charge stability, that is a variation of from about 0 to about 15 $\mu$C/gram from the average charge level as the print count, toner concentration, or other system noises are varied. The processing conditions of the carrier, and the levels of toner additives selected, can be manipulated to affect the developer charging level.

H. Developer Conductivity

A hybrid scavengeless development system involves, for example, a magnetic brush of a conventional two component system in conjunction with a donor roll used in typical single component systems to transfer toner from the magnetic brush to the photoreceptor surface. As a result, the donor roll should be completely reloaded with toner in just one revolution. The inability to complete reloading of the donor roll in one revolution can result in a print quality defect called reload. This defect is seen on prints as solid areas that become lighter with successive revolutions of the donor roll, or alternately if the structure of an image from one revolution of the donor roll is visible in the image printed by the donor roll on its next revolution, a phenomenon known as ghosting. Highly conductive developers aid in the reduction of this defect. The more conductive developers allow for the maximum transfer of toner from the magnetic brush to the donor roll. Therefore, it is desirable to select developer materials which when combined are conductive enough to reload the donor roll in a single revolution.

The conductivity of the developer is primarily driven by the carrier conductivity. To achieve a suitable conductive carrier, electrically conductive carrier cores, for example atomized steel cores, with partial coatings of electrically insulating polymers to allow a level of exposed carrier core, can be selected; conductive polymer coatings are also feasible. Additionally, irregularly shaped carrier cores provide valleys into which the polymer coating may flow leaving exposed asperities for more conductive developers. Irregularly shaped carrier cores also function to allow toner particles to contact the surface of the carrier core in the valleys to provide charge to the toner while not interfering with the contact between the uncoated carrier asperities which provides the overall developer conductivity. The addition of zinc stearate to the toner additive package also assists in the lubrication of the carrier and toner increasing the number of contacts between carrier and toner particles.

More specifically, the conductivity of the developer is, for example, about $10^{-11}$ to about $10^{-14}$ (ohm-cm)$^{-1}$ at a toner concentration of from about 3.5 to about 5.5 percent by weight as measured, for example, across a 0.1 inch magnetic brush at an applied potential of 30 volts. At a toner concentration of from about 0 to about 0.5 percent, that is bare carrier or carrier that has only a small amount of residual toner on the surface, the carrier has a conductivity of from about $10^{-8}$ to about $10^{-12}$ (ohm-cm)$^{-1}$ as measured under the same conditions.

I. Developer Toner Concentration

The toner concentration level is related to the machine selected. It is, therefore, of value to blend a developer that will achieve the desired toner concentration, and control the concentration of toner to the desired level.

More specifically, the toner concentration is, for example, about 1 to about 6 percent, and more specifically, about 3.5 to about 5.5 percent by weight of the total weight of the developer.

J. Chroma Shift

The toners should possess the appropriate color characteristics to, for example, enable a broad color gamut. The choice of colorants can enable the rendition of a higher percentage of standard PANTONE® colors than is typically available from four-color xerography. For each toner, chroma (C*) should be maximized, and the color should remain accurate relative to the requested color. Materials in the developer housing can cause the color of the toner to shift as a function of developer age, print area coverage, or other machine operating conditions, which is measured via the difference between the target color and the actual color, specifically as $\Delta E_{CMC}$, (where CMC stands for the Color Measurement Committee of the Society of Dyers and Colorists) which calculates the color change in the three dimensional L*, a*, b* CIELAB space defined in section D. The carrier may contribute to the variation in color, or chroma shift, but may only cause a shift of about $\pm\frac{1}{3}\,\Delta E_{CMC}$ units. Therefore, it is of value in embodiments to select carrier cores and carrier core coatings that will not substantially contribute to chroma shift of the toner as a function of the state of the developer.

Carrier core and coating polymers should be selected that are lightly colored or colorless and are mechanically robust to the wear experienced in the developer housing. This will minimize a change in $\Delta E_{CMC}$ performance should the carrier coating become abraded. The coating polymer and core should also be robust to mechanical wear that will be experienced in the developer housing. Robustness of the coating polymer would allow the use of darker colored additives to be utilized in the carrier coating without the risk of chroma shift.

More specifically, the $\Delta E_{CMC}$ is, for example, from at most, for example, about 0 to about 0.60, and more specifically from at most, for example, about 0 to about 0.30.

K. Carrier Size Distribution

It is desirable in embodiments to select a smaller carrier size to maintain a ratio of carrier volume median diameter to toner volume median diameter of about 10:1, with the toner volume median as determined by the known Coulter Counter technique and the carrier volume median diameter being determined by known laser diffraction techniques. This ratio enables a $TC_0$ (toner concentration) of about 1, translates into a greater tribo sensitivity to toner concentration, and allows a machine control system to use the toner concentration as a tuning knob for tribo in the housing. Also of value is to maintain a low level of toner fines in the carrier to prevent bead carry-out onto the developed prints, which generally leads to a print quality defect known as debris-centered deletions (DCDs).

In embodiments, and primarily in view of the small toner size, for example from about 4 to about 9 microns (volume median diameter), it is desirable to also select a smaller size carrier size to, for example, maintain a ratio of carrier volume median diameter to toner volume median diameter of approximately 10:1. The carrier particles thus should have an average particle size (diameter) of from, for example, about 65 to about 90 microns, and preferably from about 70 to about 84 microns. The fine side of the carrier distribution, that is the percentage of the carriers, by weight, that have a diameter of less than about half of the average particle size, can be controlled with only about 2 percent of the weight distribution having a size at from about 100 nanometers to about 38 microns.

In addition, the developer should exhibit consistent and stable developability, for example a stable developed toner mass per unit area (DMA) on the photoreceptor with a target in the range of from about 0.4 to about 1 mg/cm$^2$, as measured directly by removal of the toner in given area from the photoreceptor and subsequent weighing, or as determined indirectly by a calibrated reflectance measurement from the photoreceptor, at the operational voltages of the development device (for example, at a wire voltage of 200 V in an HSD development device), and a variation of the DMA from the target value of at most 0.4 mg/cm$^2$, more specifically, of at most 0.2 mg/cm$^2$. The developer must also exhibit high transfer efficiency to the image receiving substrate with very low residual toner left on the photoreceptor surface following transfer.

Illustrative examples of carrier particles that can be selected for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Additionally, there can be selected as carrier particles nickel berry carriers as disclosed in U.S. Pat. No. 3,847,604, the disclosure of which is hereby totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are hereby totally incorporated herein by reference. In embodiments, the carrier core is comprised of atomized steel available commercially from, for example, Hoeganaes Corporation.

The selected carrier particles can be used with or without a coating, the coating generally being comprised of fluoropolymers, such as polyvinylidene fluoride resins, terpolymers of styrene, methyl methacrylate, a silane, such as triethoxy silane, tetrafluorethylenes, other known coatings and the like. The coating may be present in an amount, for example, of from about 0.1 to about 10 percent by weight of the polymer, based on the total weight of the polymer and core. In embodiments, the carrier core is partially coated with a polymethyl methacrylate (PMMA) polymer having a weight average molecular weight of, for example, from about 300,000 to about 350,000 and which polymer is commercially available from Soken Chemicals. The PMMA is usually considered an electropositive polymer in that the polymer will generally impart a negative charge on the toner with which it is contacted. Additionally, the polymer coating may contain conductive components therein, such as carbon black, tin oxide, antimony-tin oxide, or copper iodide in an amount, for example, of from about 10 to about 70 weight percent, and more specifically, from about 20 to about 50 weight percent. The PMMA may optionally be copolymerized with any desired comonomer providing the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like.

The carrier particles may be prepared by mixing the carrier core with from, for example, between about 0.05 to about 10 percent by weight, more specifically between about 0.05 percent and about 3 percent by weight, based on the weight of the coated carrier particles, of polymer until adherence thereof to the carrier core by mechanical impaction and/or electrostatic attraction.

The polymer is more specifically applied in dry powder form and which polymer possesses an average particle size of less than about 1 micrometer, and more specifically less than about 0.5, for example, from about 0.1 to about 0.4 micrometer. Various effective suitable means can be used to apply the polymer to the surface of the carrier core particles. Examples of typical means for this purpose include combining the carrier core material and the polymer by cascade roll mixing, or tumbling, milling, shaking, electrostatic powder cloud spraying, fluidized bed, electrostatic disc processing, and with an electrostatic curtain.

The mixture of carrier core particles and polymer is then heated to a temperature below the decomposition temperature of the polymer coating. For example, the mixture is heated to a temperature of from about 90° C. to about 350° C. for a period of time of from, for example, about 10 minutes to about 60 minutes enabling the polymer to melt and fuse to the carrier core particles. The coated carrier particles are then cooled and thereafter classified to a desired particle size. The coating preferably has a coating weight of from, for example, about 0.1 to about 3 percent by weight of the carrier, preferably from about 0.5 to about 1.3 percent by weight.

In further embodiments of the invention, the polymer coating of the carrier core is comprised of PMMA, more specifically PMMA applied in dry powder form and having an average particle size of about 1 micrometer, and more specifically about 0.5 micrometer, is applied (melted and fused) to the carrier core at higher temperatures of about 220° C. to about 260° C. Temperatures above 260° C. may adversely degrade the PMMA. Triboelectric tunability of the carrier and developers of the invention is provided by the temperature at which the carrier coating is applied, higher temperatures resulting in higher tribo up to a point beyond which increasing temperature acts to degrade the polymer coating and thus lower tribo.

Illustrative examples of suitable toner resins selected for the toner and developer compositions of the present invention include vinyl polymers such as styrene polymers, acrylonitrile polymers, vinyl ether polymers, acrylate and methacrylate polymers; epoxy polymers; diolefins; polyurethanes; polyamides and polyimides; polyesters such as the polymeric esterification products of a dicarboxylic acid and a diol comprising a diphenol, crosslinked polyesters; and the like. The polymer resins selected for the toner compositions of the present invention include homopolymers or copolymers of two or more monomers. Furthermore, the above-mentioned polymer resins may also be crosslinked. Polyester resins are among the preferred binder resins that may be least affected by vinyl or document offset (Property C above).

Illustrative vinyl monomer units in the vinyl polymers include styrene, substituted styrenes such as methyl styrene, chlorostyrene, styrene acrylates and styrene methacrylates; vinyl esters like the esters of monocarboxylic acids including methyl acrylate, ethyl acrylate, n-butyl-acrylate, isobutyl acrylate, propyl acrylate, pentyl acrylate, dodecyl acrylate, n-octyl acrylate, 2-chloroethyl acrylate, phenyl acrylate, methylalphachloracrylate, methyl methacrylate, ethyl methacrylate, butyl methacrylate, propyl methacrylate, and pentyl methacrylate; styrene butadienes; vinyl chloride; acrylonitrile; acrylamide; alkyl vinyl ether and the like. Further examples include p-chlorostyrene vinyl naphthalene, unsaturated mono-olefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N-vinyl indole; N-vinyl pyrrolidone; and the like Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of the diol units in the polyester resins include ethanediols, propanediols, butanediols, pentanediols, pinacol, cyclopentanediols, hydrobenzoin, bis (hydroxyphenyl)alkanes, dihydroxybiphenyl, substituted dihydroxy biphenyls, and the like.

As one toner resin, there are selected polyester resins derived from a dicarboxylic acid and a diphenol. These resins are illustrated in U.S. Pat. No. 3,590,000, the disclosure of which is totally incorporated herein by reference. Also, polyester resins obtained from the reaction of bisphenol A and propylene oxide, and in particular including such polyesters followed by the reaction of the resulting product with fumaric acid, and branched polyester resins resulting from the reaction of dimethylterephthalate with 1,3-butanediol, 1,2-propanediol, and pentaerythritol may also be used. Further, low melting polyesters, especially those prepared by reactive extrusion, reference U.S. Pat. No. 5,227,460, the disclosure of which is totally incorporated herein by reference, can be selected as toner resins. Other specific toner resins may include styrene-methacrylate copolymers, styrenebutadiene copolymers, PLIOLITES™, and suspension polymerized styrenebutadienes, reference U.S. Pat. No. 4,558,108, the disclosure of which is totally incorporated herein by reference. One specific excellent resin binder comprises polyester resins containing both linear portions and crosslinked portions of the type described in U.S. Pat. No. 5,227,460, the disclosure of which is totally incorporated herein by reference.

The crosslinked portion of the binder consists essentially of microgel particles with an average volume particle diameter up to 0.1 micron, more specifically about 0.005 to about 0.1 micron, as determined by scanning electron microscopy and transmission electron microscopy, the microgel particles being substantially uniformly distributed throughout the linear portions. This resin may be prepared by a reactive melt mixing process as known in the art. The highly crosslinked dense microgel particles distributed throughout the linear portion impart elasticity to the resin, which improves the resin offset properties, while not substantially affecting the resin minimum fix temperature.

In embodiments, the crosslinked portion comprises essentially very high molecular weight microgel particles with high density crosslinking (as measured by gel content) and which are not soluble in substantially any solvents such as, for example, tetrahydrofuran, toluene and the like. The microgel particles are highly crosslinked polymers with a very small, if any, crosslink distance. This type of crosslinked polymer may be formed by reacting chemical initiator with linear unsaturated polymer, and more specifically linear unsaturated polyester, at high temperature and under high shear. The initiator molecule breaks into radicals and reacts with one or more double bond or other reactive site within the polymer chain forming a polymer radical. This polymer radical reacts with other polymer chains or polymer radicals many times forming a highly and directly crosslinked microgel. This renders the microgel very dense and results in the microgel not swelling very well in solvent. The dense microgel also imparts elasticity to the resin and increases its hot offset temperature while not affecting its minimum fix temperature.

The toner resin is thus, more specifically, a partially crosslinked unsaturated resin such as unsaturated polyester prepared by crosslinking a linear unsaturated resin (hereinafter called base resin), such as linear unsaturated polyester resin, preferably with a chemical initiator, in a melt mixing device such as, for example, an extruder at high temperature (e.g., above the melting temperature of the resin, and more specifically, up to about 150° C. above that melting temperature) and under high shear.

Also, the toner resin possesses, for example, a weight fraction of the microgel (gel content) in the resin mixture of from about 0.001 to about 50 weight percent, from about 1 to about 20 weight percent, and about 1 to about 10 weight percent, and yet more specifically about 2 to about 9 weight percent. The linear portion is comprised of base resin, more specifically unsaturated polyester, in the range of from about 50 to about 99.999 percent by weight of the toner resin, and more specifically in the range of from about 80 to about 98 percent by weight of the toner resin. The linear portion of the resin preferably comprises low molecular weight reactive base resin that did not crosslink during the crosslinking reaction, more specifically unsaturated polyester resin.

The molecular weight distribution of the resin is thus bimodal having different ranges for the linear and the crosslinked portions of the binder. The number average molecular weight ($M_n$) of the linear portion as measured by gel permeation chromatography (GPC) is from, for example, about 1,000 to about 20,000, and more specifically from about 3,000 to about 8,000. The weight average molecular weight ($M_w$) of the linear portion is from, for example, about 2,000 to about 40,000, and more specifically from about 5,000 to about 20,000. The weight average molecular weight of the gel portions is, on the other hand, generally greater than 1,000,000. The molecular weight distribution ($M_w/M_n$) of the linear portion is from, for example, about 1.5 to about 6, and more specifically from about 1.8 to about 4. The onset glass transition temperature (Tg) of the linear portion as measured by differential scanning calorimetry (DSC) is from, for example, about 50° C. to about 70° C.

Moreover, the binder resin, especially the crosslinked polyesters, can provide a low melt toner with a minimum fix temperature of from about 100° C. to about 200° C., more specifically about 100° C. to about 160° C., more specifically about 110° C. to about 140° C.; provide the low melt toner with a wide fusing latitude to minimize or prevent offset of the toner onto the fuser roll; and maintain high toner pulverization efficiencies. The toner resins and thus toners show minimized or substantially no vinyl or document offset.

Linear unsaturated polyesters selected as the base resin include, for example, low molecular weight condensation polymers which may be formed by the stepwise reactions between both saturated and unsaturated diacids (or anhydrides) and dihydric alcohols (glycols or diols). The resulting unsaturated polyesters are reactive (e.g., crosslinkable) on two fronts: (i) unsaturation sites (double bonds) along the polyester chain, and (ii) functional groups such as carboxyl, hydroxy, etc., groups amenable to acid base reactions. Typical unsaturated polyester base resins useful for this invention are prepared by melt polycondensation or other polymerization processes using diacids and/or anhydrides and diols. Suitable diacids and dianhydrides include but are not limited to saturated diacids and/or anhydrides, such as for example succinic acid, glutaric acid, adipic acid, pimelic acid, suberic acid, azelaic acid, sebacic acid, isophthalic acid, terephthalic acid, hexachloroendo methylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like, and mixtures thereof; and unsaturated diacids and/or anhydrides, such as for example maleic acid, fumaric acid, chloromaleic acid, methacrylic acid, acrylic acid, itaconic acid, citraconic acid, mesaconic acid, maleic anhydride, and the like, and mixtures thereof. Suitable diols include but are not limited to, for example, propylene glycol, ethylene glycol, diethylene glycol, neopentyl glycol, dipropylene glycol, dibromoneopentyl glycol, propoxylated bisphenol A, 2,2,4-trimethylpentane-1,3-diol, tetrabromo bisphenol dipropoxy ether, 1,4-butanediol, and the like, and mixtures thereof, soluble in good solvents such as, for example, tetrahydrofuran, toluene and the like.

Preferred unsaturated polyester base resins are prepared from diacids and/or anhydrides such as, for example, maleic anhydride, fumaric acid, and the like, and mixtures thereof, and diols such as, for example, propoxylated bisphenol A, propylene glycol, and the like, and mixtures thereof. A particularly preferred polyester is poly(propoxylated bisphenol A fumarate).

In embodiments of the present invention, the toner binder resin is generated by the melt extrusion of (a) linear propoxylated bisphenol A fumarate resin, and (b) crosslinked by reactive extrusion of the linear resin with the resulting extrudate comprising a resin with an overall gel content of from about 2 to about 9 weight percent. Linear propoxylated bisphenol A fumarate resin is available under the tradename SPAR II™ from Resana S/A Industrias Quimicas, Sao Paulo Brazil, or as NEOXYL P2294™ or P2297™ from DSM Polymer, Geleen, The Netherlands, for example. For suitable toner storage and prevention of vinyl and document offset, the polyester resin blend more specifically has a Tg range of from, for example, about 52° C. to about 64° C.

Chemical initiators, such as, for example, organic peroxides or azo-compounds, are preferred for the preparation of the crosslinked toner resins of the invention. Suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di(2-ethyl hexanoyl peroxy) hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di(benzoyl peroxy) hexane, oo-t-butyl o-(2-ethyl hexyl) mono peroxy carbonate, and oo-t-amyl o-(2-ethyl hexyl) mono peroxy carbonate, alkyl peroxides such as, for example, dicumyl peroxide, 2,5-dimethyl 2,5-di(t-butyl peroxy) hexane, t-butyl cumyl peroxide, bis(t-butyl peroxy) diisopropyl benzene, di-t-butyl peroxide and 2,5-dimethyl 2,5-di(t-butyl peroxy) hexyne-3, alkyl hydroperoxides such as, for example, 2,5-dihydro peroxy 2,5-dimethyl hexane, cumene hydroperoxide, t-butyl hydroperoxide and t-amyl hydroperoxide, and alkyl peroxyketals such as, for example, n-butyl 4,4-di(t-butyl peroxy) valerate, 1,1-di(t-butyl peroxy) 3,3,5-trimethyl cyclohexane, 1,1-di(t-butyl peroxy) cyclohexane, 1,1-di(t-amyl peroxy) cyclohexane, 2,2-di(t-butyl peroxy) butane, ethyl 3,3-di(t-butyl peroxy) butyrate, ethyl 3,3-di(t-amyl peroxy) butyrate and 1,1-bis(t-butyl (peroxy) 3,3,5-trimethylcyclohexane. Suitable azo-compounds include azobis-isobutyronitrile, 2,2'-azobis (isobutyronitrile), 2,2'-azobis(2,4-dimethyl valeronitrile), 2,2'-azobis(methyl butyronitrile), 1,1'-azobis(cyano cyclohexane) and other similar known compounds.

By permitting use of low concentrations of chemical initiator and utilizing substantially all of it in the crosslinking reaction, usually from about 0.01 to about 10 weight percent, and more specifically from about 0.1 to about 4 weight percent, the residual contaminants produced in the crosslinking reaction in preferred embodiments can be minimal. Since the crosslinking can be accomplished at high temperature, the reaction is very fast (e.g., less than 10 minutes, preferably about 2 seconds to about 5 minutes) and thus little or no unreacted initiator remains in the product.

The low melt toners and toner resins may be prepared by a reactive melt mixing process wherein reactive resins are partially crosslinked. For example, low melt toner resins may be fabricated by a reactive melt mixing process comprising (1) melting reactive base resin, thereby forming a polymer melt, in a melt mixing device; (2) initiating crosslinking of the polymer melt, more specifically with a chemical crosslinking initiator and increased reaction temperature; (3) retaining the polymer melt in the melt mixing device for a sufficient residence time that partial crosslinking of the base resin may be achieved; (4) providing sufficiently high shear during the crosslinking reaction to keep the gel particles formed and broken down during shearing and mixing, and well distributed in the polymer melt; (5) optionally devolatilizing the polymer melt to remove any effluent volatiles; and (6) optionally adding additional linear base resin after the crosslinking in order to achieve the desired level of gel content in the end resin. The high temperature reactive melt mixing process allows for very fast crosslinking which enables the production of substantially only microgel particles, and the high shear of the process prevents undue growth of the microgels and enables the microgel particles to be uniformly distributed in the resin.

A reactive melt mixing process is, for example, a process wherein chemical reactions can be affected on the polymer in the melt phase in a melt mixing device, such as an extruder. In preparing the toner resins, these reactions are used to modify the chemical structure and the molecular weight, and thus the melt rheology and fusing properties of the polymer. Reactive melt mixing is particularly efficient for highly viscous materials, and is advantageous because it requires no solvents, and thus is easily environmentally controlled. As the amount of crosslinking desired is achieved, the reaction products can be quickly removed from the reaction chamber.

The resin which is generally present in the toner of the present invention in, for example, an amount of from about 40 to about 98 percent by weight, and more preferably from about 70 to about 98 percent by weight, although such resins may be present in greater or lesser amounts, can be melt blended or mixed with a colorant, charge carrier additives, surfactants, emulsifiers, pigment dispersants, flow additives, embrittling agents, and the like. The resultant product can then be pulverized by known methods, such as milling, to form the desired toner particles. Waxes with, for example, a low molecular weight $M_w$ of from about 1,000 to about 10,000, such as polyethylene, polypropylene, and paraffin waxes, can be included in, or on the toner compositions as, for example, fusing release agents.

Various suitable colorants of any color can be present in the toners, including suitable colored pigments, dyes, and mixtures thereof including REGAL 330®; (Cabot), Acetylene Black, Lamp Black, Aniline Black; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like; cyan, magenta, yellow, red, green, brown, blue or mixtures thereof, such as specific phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA available from E.I. DuPont de Nemours & Company, and the like. Generally, colored pigments and dyes that can be selected are cyan, magenta, or yellow pigments or dyes, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Other colorants are magenta colorants of (Pigment Red) PR81:2, CI 45160:3. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, Cl Solvent Yellow 16, a nitrophenyl amine sulfonamide identified in the Color Index as Forum Yellow SE/GLN, CI Dispersed Yellow 33 2,5-dimethoxy-4-sulfonanilide phenylazo-4'-chloro-2,5-dimethoxy acetoacetanilides, and Permanent Yellow FGL, PY17, CI 21105, and known suitable dyes, such as red, blue, green, Pigment Blue 15:3 C.I. 74160, Pigment Red 81:3 C.I. 45160:3, and Pigment Yellow 17 C.I. 21105, and the like, reference for example U.S. Pat. No. 5,556,727, the disclosure of which is totally incorporated herein by reference.

The colorant, more specifically black, cyan, magenta and/or yellow colorant, is incorporated in an amount sufficient to impart the desired color to the toner. In general, pigment or dye is selected, for example, in an amount of from about 2 to about 60 percent by weight, and more specifically from about 2 to about 9 percent by weight for color toner and about 3 to about 60 percent by weight for black toner.

For black, the toner should in embodiments contain a suitable black pigment so as to provide a lightness, or Lno greater than about 17, for example, of from about 0 to about 17 at the operating toner mass per unit area on the print (TMA), which is typically of about 0.45 to about 0.55 milligrams per square centimeter. In embodiments, carbon black is present at a loading of about 5 percent by weight.

For the cyan toner, the toner should contain a suitable cyan pigment type and loading so as to enable as broad a color gamut as is achieved in benchmark lithographic four-color presses. In embodiments, the pigment is comprised of from about 20 percent to about 40 percent PV FAST BLUE (Pigment Blue 15:3™) from Sun Chemical dispersed in from about 80 percent to about 60 percent of a linear propoxylated bisphenol A fumarate and is loaded into the toner in an amount of (for example is intended for all amounts) from about 8 percent to about 15 percent by weight (corresponding to from about 2.4 percent to about 4.5 percent by weight pigment loading). For the yellow toner, the toner should contain a suitable yellow pigment type and loading so as to enable as broad a color gamut as is achieved in benchmark lithographic four-color presses. In embodiments, the pigment is comprised of from about 20 percent to about 40 percent Sunbrite Yellow (Pigment Yellow 17™) from Sun Chemical dispersed in from about 80 percent to about 60 percent of a linear propoxylated bisphenol A fumarate and is loaded into the toner in an amount of from about 20 percent to about 30 percent by weight (corresponding to from about 6 percent to about 9 percent by weight pigment loading).

For the magenta toner, the toner should contain a suitable magenta pigment type and loading so as to enable as broad a color gamut as is achieved in benchmark lithographic four color presses. In embodiments, the pigment is comprised of from about 20 percent to about 40 percent FANAL PINK (Pigment Red 81:2™) from BASF dispersed in from about 80 percent to about 60 percent linear propoxylated bisphenol A fumarate and is loaded into the toner in an amount of from about 12 percent to about 18 percent by weight (corresponding to from about 3.6 percent to about 5.4 percent by weight pigment loading).

Any suitable surface additives may be selected. Examples of additives are surface treated fumed silicas, for example TS-530 from Cabosil Corporation, with an 8 nanometer particle size and a surface treatment of hexamethyldisilazane; NA50HS silica, obtained from DeGussa/Nippon Aerosil Corporation, coated with a mixture of HMDS and aminopropyltriethoxysilane; DTMS silica, obtained from Cabot Corporation, comprised of a fumed silica silicon dioxide core L90 coated with DTMS; H2050EP, obtained from Wacker Chemie, coated with an amino functionalized organopolysiloxane; metal oxides such as $TiO_2$, for example MT-3103 from Tayca Corp. with a 16 nanometer particle size and a surface treatment of decylsilane; SMT5103, obtained from Tayca Corporation, comprised of a crystalline titanium dioxide core MT500B coated with DTMS; P-25 from Degussa Chemicals with no surface treatment; alternate metal oxides such as aluminum oxide, and as a lubricating agent, for example, stearates or long chain alcohols, such as UNILIN 700™, as external surface additives. In general, silica is applied to the toner surface for toner flow, tribo enhancement, admix control, improved development and transfer stability, and higher toner blocking temperature. $TiO_2$ is applied for improved relative humidity (RH) stability, tribo control and improved development and transfer stability.

The $SiO_2$ and $TiO_2$ should more specifically possess a primary particle size greater than approximately 30 nanometers, preferably of at least 40 nanometers, with the primary particles size measured by, for instance, transmission electron microscopy (TEM) or calculated (assuming spherical particles) from a measurement of the gas absorption, or BET, surface area. $TiO_2$ is found to be especially helpful in maintaining development and transfer over a broad range of area coverage and job run length. The $SiO_2$ and $TiO_2$ are more specifically applied to the toner surface with the total coverage of the toner ranging from, for example, about 140 to about 200 percent theoretical surface area coverage (SAC), where the theoretical SAC (hereafter referred to as SAC) is calculated assuming all toner particles are spherical and have a diameter equal to the volume median diameter of the toner as measured in the standard Coulter Counter method, and that the additive particles are distributed as primary particles on the toner surface in a hexagonal closed packed structure. Another metric relating to the amount and size of the additives is the sum of the "SAC×Size" (surface area coverage times the primary particle size of the additive in nanometers) for each of the silica and titania particles, or the like, for which all of the additives should, more specifically, have a total SAC×Size range of, for example, about 4,500 to about 7,200. The ratio of the silica to titania particles is generally from about 50 percent silica/50 percent titania to about 85 percent silica/15 percent titania (on a weight percentage basis), although the ratio may be larger or smaller than these values provided that the features of the invention are achieved. Toners with lesser SAC×Size could potentially provide adequate initial development and transfer in HSD systems, but may not display stable development and transfer during extended runs of low area coverage (low toner throughput).

Preferred $SiO_2$ and $TiO_2$ are surface treated with compounds including DTMS (decyltrimethoxysilane) or HMDS (hexamethyldisilazane). Examples of these additives are NA50HS silica, obtained from DeGussa/Nippon Aerosil Corporation, coated with a mixture of HMDS and aminopropyltriethoxysilane; DTMS silica, obtained from Cabot Corporation, comprised of a fumed silica, for example silicon dioxide core L90 coated with DTMS; H2050EP, obtained from Wacker Chemie, coated with an amino functionalized organopolysiloxane; and SMT5103, obtained from Tayca Corporation, comprised of a crystalline titanium dioxide core MT500B, coated with DTMS.

Calcium stearate can be selected as an additive for the toners of the present invention in embodiments thereof, the calcium stearate primarily providing lubricating properties. Also, the calcium stearate can provide developer conductivity and tribo enhancement, both due to its lubricating nature. In addition, calcium stearate enables higher toner charge and charge stability by increasing the number of contacts between toner and carrier particles. Preferred, for example, is a commercially available calcium stearate with greater than about 85 percent purity, for example from about 85 to about 100 percent pure, for the 85 percent (less than 12 percent calcium oxide and free fatty acid by weight, and less than 3 percent moisture content by weight) and which has an average particle diameter of about 7 microns and is available from Ferro Corporation (Cleveland, Ohio). Examples are SYNPRO® Calcium Stearate 392A and SYNPRO® Calcium Stearate NF Vegetable. Most preferred is a commercially available calcium stearate with greater than 95 percent purity (less than 0.5 percent calcium oxide and free fatty acid by weight, and less than 4.5 percent moisture content by weight), and which stearate has an average particle diameter of about 2 microns and is available from NOF Corporation (Tokyo, Japan). In embodiments, the toners contain from, for example, about 0.1 to about 5 weight percent titania, about 0.1 to about 8 weight percent silica, and about 0.1 to about 4 weight percent calcium stearate.

Additives are selected to enable superior toner flow properties, high toner charge and charge stability. The surface treatments on the $SiO_2$ and $TiO_2$, the relative amounts of the two additives, for example about 90 percent silica:about 10 percent titania (all percentages are by weight) to about 10 percent silica:about 90 percent titania, can be manipulated to provide a range of toner charge values, for example from about 10 microcoulombs per gram to about 60 microcoulombs per gram, as measured by the standard Faraday Cage technique. For further enhancing the positive charging characteristics of the toner developer compositions, and as optional components there can be incorporated into the toner or on its surface charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; bisulfates, and the like, and other similar known charge enhancing additives. Also, negative charge enhancing additives may also be selected, such as aluminum complexes, like BONTRON E-88®, and the like. These additives may be incorporated into the toner in an amount of from about 0.1 percent by weight to about 20 percent by weight, and more specifically from about 1 to about 3 percent by weight.

The toner composition of the present invention can be prepared by a number of known methods including melt blending the toner resin particles, and pigment particles or colorants, followed by mechanical attrition. Other methods include those well known in the art such as spray drying, melt dispersion, dispersion polymerization, suspension polymerization, extrusion, and emulsion/aggregation processes.

The toner in embodiments can be generated by first mixing the binder, more specifically comprised of both the linear resin and the resin as illustrated herein and the colorant together in a mixing device, more specifically an extruder, and then extruding the mixture. The extruded mixture is then more specifically micronized in a grinder along with about 0.3 to about 0.5 weight percent of the total amount of silica to be used as an external additive. The toner is then classified to form a toner with the desired volume median particle size and percent fines as illustrated herein. Subsequent toner blending of the remaining external additives is accomplished using a mixer or blender, for example a Henschel mixer, followed by screening to obtain the final toner product.

In embodiments, the toner process is controlled and monitored to consistently achieve toners with a number of the desirable properties illustrated herein. First, the ingredients are fed into the extruder in a closed loop system from hoppers containing, respectively, the linear resin, the crosslinked resin, the predispersed pigment (i.e., the pigment dispersed in a portion of binder such as linear propoxylated bisphenol A fumarate and is as illustrated herein) and reclaimed toner fines. Reclaimed toner fines are those toner particles that have been removed from previously made toner during classification as being too small. As this can be a large percentage of material, it is most preferred to recycle this material back into the method as reclaimed toner fines. This material thus already contains the resins and the colorant, as well as any additives introduced into the toner at the extrusion, grinding, or classification processes. It may comprise from about 5 to about 50 percent by weight of the total material added into the extruder.

As the extrudate passes through the die, it is monitored with one or more monitoring devices that can provide feedback signals to control the amounts of the individual materials added into the extruder so as to carefully control the composition and properties of the toner, and thus ensure that a consistent product is obtained. In embodiments of the present invention tight and consistent toner functional properties are desired. In embodiments the extrudate is monitored with both an on-line rheometer and a near IR spectrophotometer as the monitoring devices. The on-line rheometer evaluates the melt rheology of the product extrudate and provides a feedback signal to control the amount of linear and crosslinked resin being dispensed. For example, if the melt rheology is too high, the signal indicates that the amount of linear resin added relative to the crosslinked resin should be increased. This monitoring provides control of the toner melt rheology, one of the properties that must be met in order for the performance in an HSD device to be maximized as illustrated herein.

The near IR spectrophotometer used in transmission mode can distinguish between the colors and monitor colorant concentration. The spectrophotometer can be used to generate a signal to appropriately adjust the amount of colorant added into the extruder. This monitoring provides control over the amount of pigmentation and thereby enables the functionality of toner chroma and can also identify color cross-contamination. By this monitoring, any out-of-specification product can be intercepted at the point of monitoring and purged from the line while in-specification product can continue downstream to the grinding and classification equipment. The addition of a portion of the total amount of silica to be added facilitates the grind and class operations. Specifically, injection into the grinder of from about 0.1 to about 1 percent of a silica or a metal oxide flow aid can decrease the level of variability in the output of the grinding operation allowing for further control of the grinding process, and allowing it to operate at an optimized level. Additionally, this process can enhance the jetting rate of the toner by from about 10 to about 20 percent. When the toner which is ground in this manner is classified to remove the fine portion of the toner particles, the classification yield and throughput rate are improved which helps control costs during the classification step where very tight control over particle size and distribution must be maintained for the toner to achieve the properties illustrated herein.

Classified toner product is then blended with the external surface additives in a manner to enable even distribution and firm attachment of the surface additives, for example by using a high intensity blender. The blended toner achieved has the appropriate level and stability of toner flow and triboelectric properties.

The resulting toner particles can then be formulated into a developer composition. Preferably, the toner particles are mixed with carrier particles to achieve a two-component developer composition.

Also, to achieve a number of the print quality attributes illustrated herein, developer materials should function in a consistent, predictable manner the same as the toner materials as illustrated herein. One developer material parameter enabling the toners to operate, particularly in the hybrid scavengeless development system atmosphere, are developer charge, developer conductivity, developer toner concentration, mass flow and bulk density of the developer, carrier size distribution, carrier magnetic properties and chroma shift as illustrated hereinafter.

COMPARATIVE EXAMPLE 1

Yellow Toner with ZnSt:

A yellow toner was prepared by melt mixing together 26.67 percent by weight of a first component of a dispersion of 30 percent by weight of Sunbrite Yellow (PY17, CI 21105™) in a polyester SPAR II™ resin, and a second component of about 73.33 percent by weight of a propoxylated bisphenol A fumarate resin having a gel content of about 5 percent by weight. The resulting toner had a total pigment loading of about 8 percent by weight. The toner also comprised 4.5 percent by weight of decyltrimethoxysilane (DTMS) treated silica with a 40 nanometer average particle diameter (available from Cabot Corporation), 2.7 percent by weight of DTMS treated titania with a 40 nanometer average particle diameter (SMT-5103, available from Tayca Corporation), 0.3 percent by weight of silica treated with a coating of polydimethyl siloxane units and with amino/ammonium functions chemically bonded onto the surface (H2050EP available from Wacker Chemie), and 0.5 percent of ZnSt, available from Ferro Corporation.

The toner had a volume median particle size of about 7.3 μm with percent fines less than about 5 μm of no more than 15 percent by number as measured by a Coulter Counter.

This toner was formed into a developer by combining it with a carrier comprised of a 77 μm diameter steel core (supplied by Hoeganaes North America Corporation) coated at 200° C. with 1 percent by weight of PMMA (supplied by Soken).

Thereafter, the triboelectric charge on the toner particles was determined by the known Faraday Cage process. The developer was aggressively mixed in a paint shaker (Red Devil 5400, modified to operate between 600 and 650 RPM) for a period of 90 minutes. It was believed that this process simulated a mechanical energy input to a toner particle equivalent to that applied in a xerographic housing environment in a low toner throughout mode, that is, a xerographic housing producing a print in which from about 0 to about 2 percent of the print was covered by toner developed from that housing for a period of about 100 to about 10,000 impressions. After 90 minutes, the tribo was about −45.1 microcoulombs per gram. A spectrum of the charge distribution was obtained of the developer using the known charge spectrograph, reference U.S. Pat. No. 4,375,673, the disclosure of which is totally incorporated herein by reference. The charge spectra for the toner from these developers when expressed as particle number (y-axis) plotted against toner charge divided by the toner diameter (x-axis) consisted of one or more peaks, and the toner charge divided by diameter (referred to as toner Q/D value (values) at the particle number maximum (maxima) served to characterize the developers. The developer in this Example was unimodal with a Q/D value at the particle number maximum of about −0.81 femtocoulomb per micron. Further, the conductivity of the developer as determined by forming a 0.1 inch long magnetic brush of the developer, and measuring the conductivity by imposing a 30 volt potential across the brush was $3.9\times10^{-13}$ $(\text{mho-cm})^{-1}$. Therefore, this developer was semiconductive.

Fuser Roll:

Procedure: The developer was operated in a Xerox Corporation 4890 xerographic engine, modified by removing the fusing subsystem, and the resulting unfused prints were fused in a soft roll fusing subsystem in which an amino functionalized oil was applied to the fuser roll through a standard and known release agent management (RAM) subsystem. The fuser roll was maintained at a temperature of 360° F. by heating the fuser roll both internally and with 2 external heat rolls. Paper was separated from the fuser roll after the image was fused to the paper by means of an air stream, or air knife, directed at the paper/fuser roll interface. Prints generated with yellow toner of this Example were directed through the fusing subsystem on a variety of paper stocks, including 90 grams per square meter Color Expressions paper, 74 per square meter Satinkote paper, 67 per square meter Accent Opaque paper, and 60 per square meter Cascade bond paper.

The performance of the fusing subsystem was monitored with several different response factors. The first response factor was the air knife pressure required to separate the paper from the fuser roll. Acceptable pressures were from about 0 psi and about 20 psi; an air knife pressure required to strip the paper from the fuser roll of from about 20 psi to about 30 psi for any basis weight paper was considered a stripping failure. For the toner of this Comparative Example, at a print count of about 350,000 impressions, the air knife pressure required to strip 60 per square meter Cascade bond paper from the fuser roll increased to 25 psi and the fuser roll was considered to have failed for stripping. A second response factor was the difference in image gloss between the first print run in the test and the image gloss at any subsequent point in the test. Because the gloss decreases with printing due to fuser roll wear causing an increase in surface roughness, this was referred to as gloss loss. With the toner of the present Comparative Example, the gloss loss increased linearly with print count to a level of 22 Gardner Gloss Units (ggu) at a print count of approximately 300 kp. This caused the image gloss to fall below the lower specification limit of 40 ggu, a lower limit defined by visual inspection of prints by end use customers, and was another metric for fuser roll failure. Therefore, by these two metrics, the fuser roll life with the toner of the present Comparative Example was approximately 300 to about 350 kp.

EXAMPLE I

Yellow Toner with CaSt from NOF:

A yellow toner was prepared by melt mixing together 26.67 percent by weight of a first component of a dispersion of 30 percent by weight of Sunbrite Yellow (PY17, CI 21105M) in SPAR II™ polyester resin, obtained from Hercules Chemical, and a second component of about 73.33 percent by weight of a propoxylated bisphenol A fumarate resin having a gel content of about 5 percent by weight. The resulting toner had a total pigment loading of about 8 percent by weight. The toner also comprised, preferably as external additives, about 4.5 percent by weight of decyltrimethoxysilane (DTMS) treated silica with a 40 nanometer average particle diameter (available from Cabot Corporation), 2.7 percent by weight of DTMS treated titania with a 40 nanometer average particle diameter (SMT-5103, available from Tayca Corporation), 0.3 percent by weight of silica treated with a coating of polydimethyl siloxane units and with amino/ammonium functions chemically bonded onto the surface (H2050EP available from Wacker Chemie), and 0.5 percent of calcium stearate, available from NOF Corporation.

The toner had a volume median particle size of about 7.3 μm with percent fines less than about 5 μm of no more than 15 percent by number as measured by a Coulter Counter.

This toner was formed into a developer by combining it with a carrier comprised of a 77 μm steel core (supplied by Hoeganaes North America Corporation) coated at 200° C. with 1 percent by weight of PMMA (supplied by Soken).

Thereafter, the triboelectric charge on the toner particles was determined by the known Faraday Cage process. The developer was aggressively mixed in a paint shaker (Red Devil 5400, modified to run from about 600 to about 650 RPM) for a period of 90 minutes. It was believed that this process simulates a mechanical energy input to a toner particle equivalent to that applied in a xerographic housing environment in a low toner throughout mode, that is, a xerographic housing making print in which about 0 to about 2 percent of the print was covered by toner developed from that housing for a period of about 100 to about 10,000 impressions. After 90 minutes, the tribo was about −40 microcoulombs per gram. A spectrum of the charge distribution was obtained of the developer with the charge spectrograph, reference U.S. Pat. No. 4,375,673, the disclosure of which is totally incorporated herein by reference. The charge spectra for the toner from these developers, when expressed as particle number (y-axis) plotted against toner charge divided by the toner diameter (x-axis), consisted of one or more peaks, and the toner charge divided by diameter (referred to as toner Q/D) value (values) at the particle number maximum (maxima) served to characterize the developers. The developer in this Example was unimodal with a Q/D value at the particle number maximum of about −0.72 femtocoulomb per micron. Further, the conductivity of the developer as determined by forming a 0.1 inch long magnetic brush of the developer, and measuring the conductivity by imposing a 30 volt potential across the brush was $4\times10^{-13}$ (mho-cm)$^{-1}$. Therefore, this developer was semiconductive. These properties are substantially similar to those of Comparative Example 1.

Fuser Roll Life Test

Procedure: The above developer was operated in a Xerox Corporation 4890 xerographic engine, modified by removing the fusing subsystem, and the resulting unfused prints were fused in a soft roll fusing subsystem in which an amino functionalized oil was applied to the fuser roll through a standard release agent management (RAM) subsystem. The fuser roll was maintained at a temperature of 360° F. by heating the fuser roll both internally and with 2 external heat rolls. Paper was separated from the fuser roll after the image was fused to the paper by means of an air stream, or air knife directed at the paper/fuser roll interface. Prints generated with yellow toner of this Example were directed through the fusing subsystem on a variety of paper stocks, including 90 grams per square meter Color Expressions paper, 74 grams per square meter Satinkote paper, 67 grams per square meter Accent Opaque paper, and 60 grams per square meter Cascade bond paper.

The performance of the fusing subsystem was monitored with several different response factors. The first response factor was the air knife pressure required to separate the paper from the fuser roll. Acceptable pressures were from about 0 psi to about 20 psi; an air knife pressure required to strip the paper from the fuser roll of from about 20 psi to about 30 psi for any basis weight paper was considered a stripping failure. For the toner of this Example, the air knife pressure required to strip all papers in the test remained from about 0 to about 20 psi for 1 million impressions, at which point the test was suspended for unrelated mechanical failure of the fuser roll. Therefore, for up to 1 million impressions the fuser roll was not considered to have failed for stripping at any point, and with no offset failures. A second response factor was the difference in image gloss between the first print run in the test and the image gloss at any subsequent point in the test. Because the gloss decreased with printing due to fuser roll wear causing an increase in surface roughness, this was referred to as gloss loss. With the toner of the present Example, the gloss loss was low and constant, at about 5 ggu throughout the 1 million impressions life of the test, and the absolute level of the gloss remained at 50 ggu for the life of the test, well above the lower specification limit of 40 ggu. Therefore, by these two metrics, the fuser roll life with the toner of the present Example was about 1 million impressions, an increase of approximately 700,000 impressions, or approximately 117 hours of running time, or approximately 200 percent over the fuser roll life with the toner of Comparative Example 1.

EXAMPLE II

Yellow Toner with CaSt (Calcium Stearate) (Ferro Corporation):

A yellow toner was prepared by melt mixing together 26.67 percent by weight of a first component of a dispersion of 30 percent by weight Sunbrite Yellow (PY17, CI 21105™) in SPAR II™ resin and a second component of 73.33 percent by weight of a propoxylated bisphenol A fumarate resin having a gel content of about 5 percent by weight. The resulting toner had a total pigment loading of about 8 percent by weight. The toner also comprised 4.5 percent by weight of decyltrimethoxysilane (DTMS) treated silica with a 40 nanometer average particle diameter (available from Cabot Corporation), 2.7 percent by weight of DTMS treated titania with a 40 nanometer average particle diameter (SMT-5103, available from Tayca Corporation), 0.3 percent by weight of silica treated with a coating of polydimethyl siloxane units with amino/ammonium functions chemically bonded onto the surface (H2050EP available from Wacker Chemie), and 0.5 percent of CaSt, obtained from Ferro Corporation.

The toner resulting had a volume median particle size of about 7.3 μm with percent fines less than about 5 μm of no more than 15 percent by number as measured by a Coulter Counter.

This toner was formed into a developer by combining with a carrier comprised of a 77 μm steel core (supplied by Hoeganaes North America Corporation) coated at 200° C. with 1 percent by weight PMMA (supplied by Soken) at 200° C.

Thereafter, the triboelectric charge on the toner particles was determined by the known Faraday Cage process. The developer was aggressively mixed in a paint shaker (Red Devil 5400, modified to run between 600 and 650 RPM) for a period of 90 minutes. It was believed that this process simulates a mechanical energy input to a toner particle equivalent to that applied in a xerographic housing environment in a low toner throughout mode, that is, a xerographic housing making print in which from about 0 to about 2 percent of the print was covered by toner developed from that housing for a period of from about 100 to about 10,000 impressions. After 90 minutes, the tribo was about −37 microcoulombs per gram. A spectrum of the developer charge distribution was obtained of the developer with using the charge spectrograph, reference U.S. Pat. No. 4,375,673, the disclosure of which is totally incorporated herein by reference. The charge spectra for the toner from these developers, when expressed as particle number (y-axis) plotted against toner charge divided by the toner diameter (x-axis), consisted of one or more peaks, and the toner charge divided by diameter (referred to as toner Q/D) value (values) at the particle number maximum (maxima) served to characterize the developers. The developer in this Example was unimodal with a Q/D value at the particle number maximum of about −0.72 femtocoulomb per micron. Further, the conductivity of the developer as determined by forming a 0.1 inch long magnetic brush of the developer, and measuring the conductivity by imposing a 30 volt potential across the brush was $3.4\times10^{-13}$ (mho-cm)$^{-1}$. Therefore, this developer was semiconductive. These properties were substantially similar to those of Comparative Example 1.

Fuser Roll Life Test:

Procedure: The above prepared developer was operated in a Xerox Corporation 4890 xerographic engine modified by removing the fusing subsystem, and the resulting unfused prints were fused in a soft roll fusing subsystem in which an amino functionalized oil was applied to the fuser roll through a standard release agent management (RAM) subsystem. The fuser roll was maintained at a temperature of 360° F. by heating the fuser roll both internally and with 2 external heat rolls. Paper was separated from the fuser roll after the image was fused to the paper by means of an air stream, or air knife, directed at the paper/fuser roll interface. Prints generated with yellow toner of this Example were directed through the fusing subsystem on a variety of paper stocks, including 90 gram per square meter Color Expressions paper, 74 grams per square meter Satinkote paper, 67 grams per square meter Accent Opaque paper, and 60 grams per square meter Cascade bond paper.

The performance of the fusing subsystem was monitored with several different response factors. The first response factor was the air knife pressure required to separate the paper from the fuser roll. Acceptable pressures were from about 0 psi to about 20 psi; an air knife pressure required to strip the paper from the fuser roll of from about 20 psi to about 30 psi for any basis weight paper was considered a stripping failure. For the toner of this Example, the air knife pressure required to strip all papers in the test will remain from about 0 to about 20 psi for 1 million impressions, at which point the test was suspended for unrelated mechanical failure of the fuser roll. Therefore, after about 1,000,000 impressions the fuser roll was not considered to have failed for stripping at any point. A second response factor was the difference in image gloss between the first print run in the test and the image gloss at any subsequent point in the test. Because the gloss decreases with printing due to fuser roll wear causing an increase in surface roughness, this was referred to as gloss loss. With the toner of the present example, the gloss loss was believed to remain low and constant, at about 5 ggu throughout the 1 million impression life of the test, and the absolute level of the gloss will remain at 50 ggu for the life of the test, well above the lower specification limit of 40 ggu. Therefore, by these two metrics, the fuser roll life with the toner of the present Example was in need of a specific value excess of 1 million impressions, an increase of approximately 700,000 impressions, or approximately 117 hours of running time, or approximately 200 percent over the fuser roll life with the toner of Comparative Example 1.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An apparatus comprised of a charging component, a development component, a transport component, a photoconductive component, and a fusing component, and wherein the development component contains a toner comprising at least one binder in an optional amount of from about 85 to about 99 percent by weight, at least one colorant in an optional amount of from about 0.5 to about 15 percent by weight, and calcium stearate in an optional amount of from about 0.05 to about 2 percent by weight and wherein following triboelectric contact with carrier particles, the toner has a charge Q measured in femtocoulombs per particle diameter D measured in microns (Q/D) of from about −0.1 to about −1 fC/$\mu$m with a variation during development of from about 0 to about 0.25 fC/$\mu$m and wherein the distribution is substantially unimodal and possesses a peak width of from about 0.1 fC/$\mu$m to about 0.5 fC/$\mu$m and the toner possesses a charge to mass M, as measured in grams, ratio (Q/M) of from about −25 to about −70 $\mu$C/gram with variation of Q/M during development of from about 0 to about 15 $\mu$C/gram.

2. An apparatus in accordance with claim 1 wherein said apparatus is a xerographic device.

3. An apparatus in accordance with claim 1 wherein the charge to mass ratio of the toner is from about −30 to about −60 $\mu$C/gram.

4. An apparatus in accordance with claim 1 wherein the toner contains low charge toner particles of equal to or less than about 15 percent of the total number of toner particles, and wrong sign toner particles equal to or less than about 5 percent of the total number of toner particles.

5. An apparatus in accordance with claim 1 wherein the toner contains low charge toner of equal to or less than about 6 percent of the total number of toner particles, and wrong sign toner particles equal to or less than about 3 percent of the total number of toner particles.

6. An apparatus in accordance with claim 1 wherein the toner possesses a volume median diameter of from about 6.9 to about 7.9 microns.

7. An apparatus in accordance with claim 1 wherein the toner possesses a size distribution such that about 30 percent or less of the total number of toner particles have a size less than about 5 microns, and about 0.7 percent or less of a total volume of toner particles with a size greater than about 12.70 microns.

8. An apparatus in accordance with claim 1 wherein the toner possesses a volume median diameter of from about 7.1 to about 7.7 microns.

9. An apparatus in accordance with claim 1 wherein the toner has a low volume ratio GSD of approximately 1.23, and a volume GSD of about 1.21.

10. An apparatus in accordance with claim 1 wherein the toner melt viscosity is from about $3\times10^4$ to about $6.7\times10^4$ poise at a temperature of about 97° C., from about $4\times10^3$ to about $1.6\times10^4$ poise at a temperature of about 116° C., or from about $6.1\times10^2$ to about $5.9\times10^3$ poise at a temperature of about 136° C.

11. An apparatus in accordance with claim 1 wherein the toner elastic modulus is from about $6.6\times10^5$ to about $2.4\times10^6$ dynes per square centimeter at a temperature of about 97° C., from about $2.6\times10^4$ to about $5.9\times10^5$ dynes per square centimeter at a temperature of about 116° C., and from about $2.7\times10^3$ to about $3\times10^5$ dynes per square centimeter at a temperature of about 136° C.

12. An apparatus in accordance with claim 1 wherein the toner melt flow index (MFI) is from about 1 to about 25 grams per about 10 minutes at a temperature of about 117° C.

13. An apparatus in accordance with claim 1 wherein said binder has a glass transition temperature of from about 52° C. to about 64° C.

14. An apparatus in accordance with claim 1 wherein said binder comprises a propoxylated bisphenol A fumarate resin, and said resin possesses an overall gel content of from about 2 to about 9 percent by weight of the binder.

15. An apparatus in accordance with claim 1 wherein the colorant is carbon black, magnetite, or mixtures thereof, cyan, magenta, yellow, blue, green, red, orange, violet, brown, or mixtures thereof.

16. An apparatus in accordance with claim 1 further including external additives of a silicon dioxide powder, a metal oxide powder, or mixtures thereof.

17. An apparatus in accordance with claim 16 wherein the metal oxide powder is titanium dioxide or aluminum oxide.

18. An apparatus in accordance with claim 1 wherein said external additives are of a SAC×size (theoretical surface area coverage×primary particle size of the external additive in nanometers) of from about 4,500 to about 7,200.

19. An apparatus in accordance with claim 1 wherein different colors of said toner develop a latent image upon said photoconductive surface by image-on-image processing with hybrid scavengeless development, the developed images then being transferred to an image receiving substrate.

20. An apparatus in accordance with claim 1 wherein said calcium stearate is present in an amount of from about 0.05 to about 2 weight percent.

21. A xerographic apparatus containing a development component and a photoconductive component, and which component contains a toner comprised of at least one binder in an amount of from about 70 to about 98 percent by weight, at least one colorant in an amount of from about 0.5 to about 15 percent by weight, and calcium stearate in an amount of from about 0.05 to about 2 percent by weight and wherein following triboelectric contact with carrier particles, the toner has a charge Q measured in femtocoulombs per particle diameter D measured in microns (Q/D) of from about −0.1 to about −1 fC/$\mu$m with a variation during development of from about 0 to about 0.25 fC/$\mu$m and wherein the distribution is substantially unimodal and possesses a peak width of from about 0.1 fC/$\mu$m to about 0.5 fC/$\mu$m and the toner possesses a charge to mass M, as measured in grams, ratio (Q/M) of from about −25 to about −70 $\mu$C/gram with variation of Q/M during development of from about 0 to about 15 $\mu$C/gram.

* * * * *